United States Patent [19]

Wiczer

[11] 4,398,718

[45] Aug. 16, 1983

[54] ILLUMINATED FLIPPER ASSEMBLY

[75] Inventor: Max Wiczer, Skokie, Ill.

[73] Assignee: Wico Corporation, Niles, Ill.

[21] Appl. No.: 277,189

[22] Filed: Jun. 25, 1981

[51] Int. Cl.[3] ..... A63B 67/08

[52] U.S. Cl. ..... 273/129 V

[58] Field of Search ..... 273/129 V, 129 D, 127 R, 273/119 A, 120 A, 121 A, 122 A, 123 A, 124 A, 85 A, 129, 127, 119, 120, 121, 122, 123, 125, 85 G, 125 A; 200/61.11

[56] References Cited

U.S. PATENT DOCUMENTS 2,319,786 5/1943 Binks ..... 200/61.11

3,298,691 1/1967 Berninger et al. ..... 273/129 R

FOREIGN PATENT DOCUMENTS 58735 11/1953 France ..... 273/119 A

*Primary Examiner*—Richard C. Pinkham

*Assistant Examiner*—T. Brown

*Attorney, Agent, or Firm*—Dithmar, Stotland, Stratman & Levy

[57] ABSTRACT

The flipper assembly has a transparent flipper carried by a rotatable flipper shaft. A light shaft extends through the flipper shaft and is fixed to the pinball game. A bulb is located in the flipper and is carried by the bulb shaft.

7 Claims, 3 Drawing Figures

ILLUMINATED FLIPPER ASSEMBLY

BACKGROUND OF THE INVENTION

This application is directed generally to pinball games and specifically to a flipper assembly used in such games.

In a flipper game, the pinball is shot onto the pinball playfield which carries a number of targets of various kinds. Because of the incline of the playfield board, the ball falls toward the mouth of a chute. As the ball strikes or enters the various targets, points are added to the player's score. Once the ball reaches the chute, no additional points can be obtained by that ball.

To increase the time the ball is on the playfield board, pinball games commonly have one or more flippers located near the mouth of the chute. The flipper(s) is actuated by a button(s) accessible to the player. When the ball strikes the flipper, the player actuates the button, causing the flipper to kick the ball back up the playfield board to strike further targets and increase the player's score.

Lights and sounds seem to make a pinball more enjoyable for the players. In addition, illuminating the flipper itself improves the ability of the player to see it. In one pinball game that has been available in the marketplace, the flipper is illuminated in its rest position by means of a lamp located in the playfield board, which produces light that is directed upward and into the flipper. Esthetically, such a flipper is not particularly pleasing because when it is operated, the flipper pivots to a position where it is no longer aligned with the lamp and it then becomes dark.

SUMMARY OF THE INVENTION

It is therefore an object of this invention to provide an improved flipper assembly for pinball games.

Another object is to provide a flipper assembly which has a flipper that is illuminated in its rest position and also while it is pivoting to kick the pinball up the playfield board.

Another object is to provide a flipper containing illumination means so that the flipper is always illuminated while at the same time reducing the possibility of damage to the illumination means.

In summary, there is provided an illuminated flipper assembly for pinball games having a playfield board, a flipper pivoting mechanism and a source voltage, the assembly comprising a transparent flipper, a flipper shaft carrying the flipper and being adapted to be attached to the flipper pivoting mechanism and to be rotatable with respect to the playfield board, bulb means in the flipper, and means for electrically connecting the bulb means to the source of voltage.

In one specific form of the invention, a light shaft extends through a bore in the flipper shaft and is nonrotatably attached to the pinball game. The bulb is attached to wires extending through a bore in the light shaft.

The invention consists of certain novel features and a combination of parts hereinafter fully described illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings, a preferred embodiment thereof from an inspection of which, when considered in connection with the following description, the invention, its construction and operation, and many of its advantages should be readily understood and appreciated.

DETAILED DESCRIPTION OF THE PREFERRED EMBODIMENT

Figure 2:
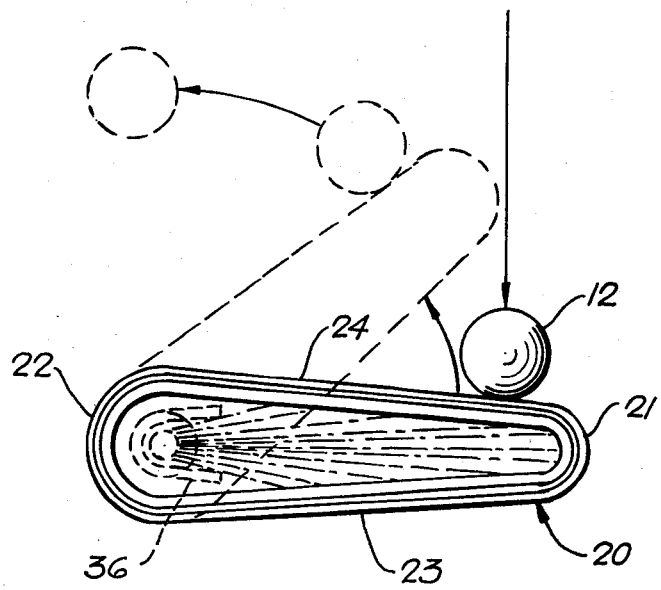
FIG. 2 is a plan view of the flipper assembly and the manner in which it operates.
Figure 1:
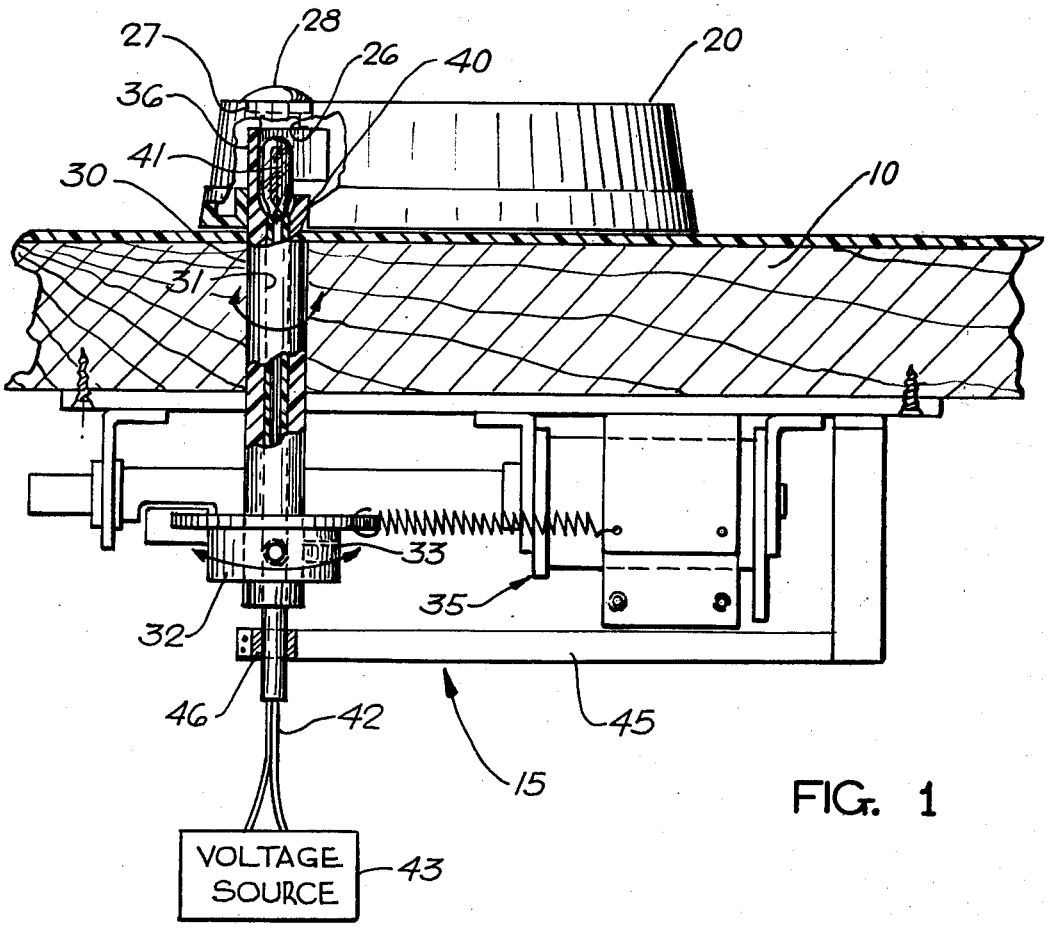
FIG. 1 depicts a fragmentary portion of a playfield board to which is mounted an illuminated flipper assembly incorporating the features of the present invention.
Figure 3:
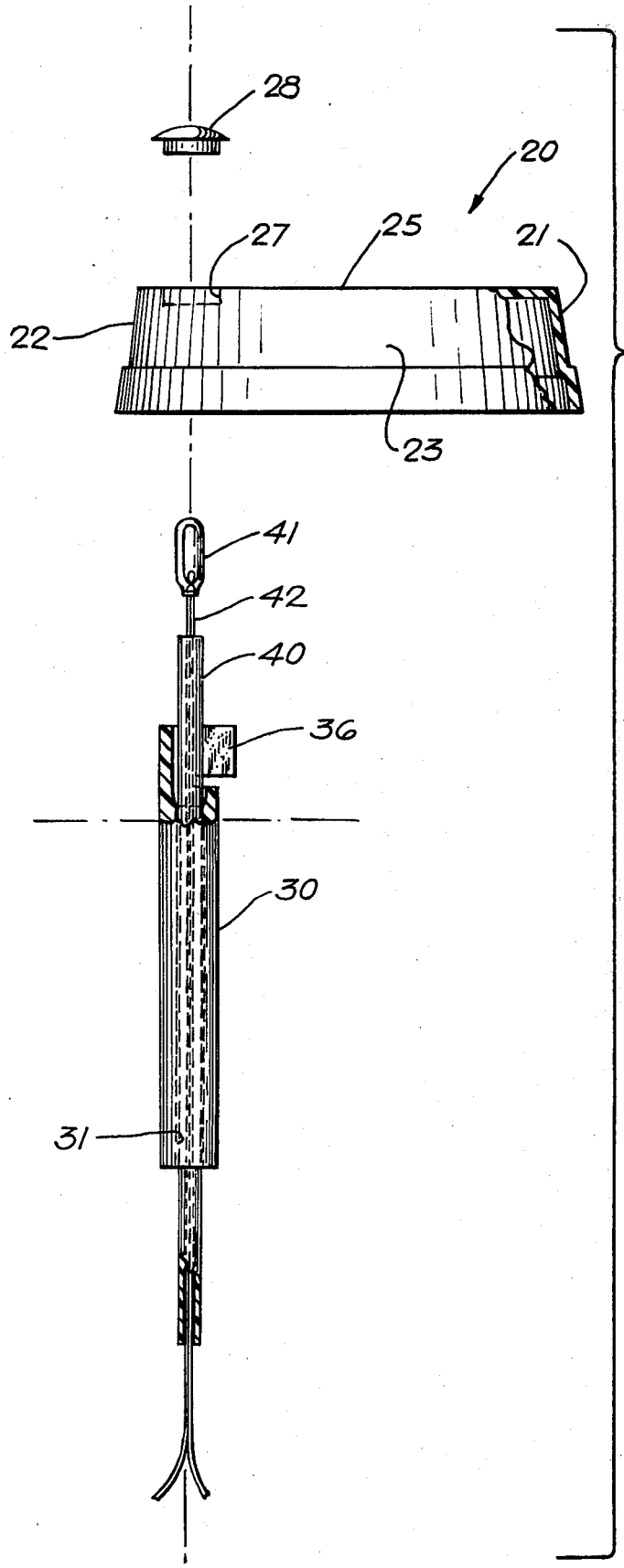
FIG. 3 is an exploded view of the flipper assembly.

Referring now to the drawings, there is depicted a playfield board 10 of a pinball game. A pinball 12 is delivered onto the playfield board by shooter mechanism not pertinent to the present invention. A number of targets (not shown) are located at various points on the playfield board. As the pinball 12 strikes the targets or drops into the targets, points are added to the player's score. The playfield board 10 is inclined downwardly so that the pinball 12 falls toward the player while it strikes and drops into these targets. Near the shooter, where the pinball 12 drops, there is located one or more flipper assemblies 15, each having an associated flipper 20. As shown in FIG. 2, the flipper is tapered so that it has a narrow end 21, a wide end 22, converging sides 23 and 24, and a top 25. The flipper 20 is rotatable about a vertical axis of rotation adjacent its wide end 22. When the pinball 12 strikes any part of the side 24, the player actuates a button (not shown) that is accessible to him causing the flipper 20 to rotate counterclockwise, in this case, kicking the ball up the playfield board.

The flipper 20 is molded of transparent material. The flipper 20 has a hole 26 centered about the axis of rotation of the flipper 20. A recess 27 communicates with the hole 26. A cap 28 with a depending skirt frictionally fits into the recess 27 to close the hole 26.

The flipper assembly 15 includes a tubular shaft 30 having a bore 31 extending longitudinally along its axis. A collar 32 is fixed to the shaft 30 by means of one or more set screws 33. In turn, the collar 32 is attached to a pivoting mechanism 35. The pivoting mechanism is energized when the user-accessible button is depressed causing the shaft 30 to rotate counterclockwise and carry the flipper 20 in the same direction.

The upper end 36 of the shaft 30 is disposed within the flipper 20. The end 36 is generally U-shaped in transverse cross section so as to define a reflector. The flipper 20 may be molded directly onto the shaft 30 or the pieces may be made separately and cemented together.

The diameter of the hole in the playfield board 10 is greater than the diameter of the shaft 30 which passes through such hole so that the shaft 30 is rotatable with respect to the playfield board 10.

Located in the bore 31 is a second tubular shaft 40. A bulb 41 is carried by the shaft 40 and a pair of wires 42 attached to the bulb 41 extend through the bore of the shaft 40 for connection to a voltage source 43 which illuminates the bulb 41. Light is directed from the bulb 41 by the reflector end 36 toward the end 21, sides 23 and 24 and the top 25 of the flipper 20. Because the flipper 20 is made of a transparent material, the entire flipper 20 is illuminated.

The pinball game has a mounting plate 45 which is attached indirectly to the underside of the playfield board 10. The outer end of the mounting plate 45 is attached by means of a collar 46 to the shaft 40, whereby the shaft 40 is nonrotatably attached to the playfield board 10. The outer diameter of the shaft 40 is slightly less than the diameter of the bore 31 so that the shaft 30 can rotate even though the shaft 40 does not. This construction enables the flipper 20 in effect to carry its own light source in such a way that the light source is not subjected to damaging movement during use. In other words, the light source is stationary even though it is located in the flipper 20. Such construction also prevents the wires from becoming twisted. Also this construction diverts from the bulb 41 the shock of the pinball 12 striking the flipper 20. Even though the bulb 41 is located in the flipper 20 the shock translated to the bulb 41 is minimized thereby greatly prolonging its life.

In assembling the flipper assembly 15, the pivoting mechanism 35 is attached to the underside of the playfield board where the shaft 30 is connected and the flipper 20 attached. The cap 28 is removed and the shaft 40 having bulb 41 and wires 42 associated therewith is inserted through the hole 26. The shaft 30 is attached to the mounting plate 45 by means of the collar 46 and the wires 42 connected to the voltage source 43. The cap 28 is then applied. When the bulb 41 has to be changed, the cap 28 is removed, the wires disconnected from the voltage source 43 and the collar 46 disconnected. The bulb is replaced and a new bulb affixed to the shaft and the shaft 40 is then inserted into place as described above.

What has been described is an improved flipper assembly for a pinball game in which the flipper is illuminated not only while the flipper is in its rest position but also when it is pivoted to its use position, by means of a bulb located inside the flipper.

I claim:

1. An illuminated flipper assembly for a pinball game having a playfield board, a pivoting mechanism and a source of voltage, said assembly comprising: a transparent flipper, a flipper shaft carrying said flipper and coupled to the flipper pivoting mechanism for rotation thereby with respect to the playfield board, said flipper shaft having a bore extending therethrough, a light shaft loosely extending through the bore in said flipper shaft and nonrotatably carried by the playfield board, said light shaft having a bore extending therethrough, a bulb carried by said light shaft, and wires extending through the bore in said light shaft for attachment to the source of voltage.

2. The illuminated flipper assembly of claim 1, and further comprising means adjacent said bulb for directing light therefrom toward the free end and sides of said flipper.

3. The illuminated flipper assembly of claim 1, wherein said flipper is molded to said flipper shaft.

4. The illuminated flipper assembly of claim 1, and further comprising means on said flipper shaft and integral therewith for directing light from said bulb toward the free end and the sides of said flipper.

5. The flipper assembly of claim 4, wherein said light directing means is generally U-shaped in transverse cross section.

6. The flipper assembly of claim 1, wherein said flipper has a hole aligned with said light shaft and of a diameter greater than the diameter of said light shaft, during assembly said light shaft being insertable through said hole and into said flipper shaft bore, and further comprising a cap for said hole.

7. In a pinball game having a playfield board, a flipper pivoting mechanism, and a source of voltage, the improvement comprising: a mounting plate, a transparent flipper, a flipper shaft carrying said flipper and being attached to the flipper pivoting mechanism for rotation thereby with respect to the playfield board, said flipper shaft having a bore extending therethrough, a light shaft extending through the bore in said flipper shaft and being nonrotatably attached to said mounting plate, said light shaft having a bore extending therethrough, a bulb carried by said light shaft, and wires extending through the bore in said light shaft for interconnecting said bulb and the source of voltage.

* * * * *